US007967054B2

(12) United States Patent
Deutschmann et al.

(10) Patent No.: US 7,967,054 B2
(45) Date of Patent: Jun. 28, 2011

(54) MOLD-FORMING ASSEMBLY

(75) Inventors: Herbert Deutschmann, New Hamburg (CA); Timothy Deutschmann, New Hamburg (CA)

(73) Assignee: H.D. Patterns and Matchplates Inc., New Hamburg, ON ( * ) Notice: Subject to any disclaimer, the term of this patent is extended or adjusted under 35 U.S.C. 154(b) by 293 days.

(21) Appl. No.: 12/465,290

(22) Filed: May 13, 2009

(65) Prior Publication Data

US 2009/0283239 A1 Nov. 19, 2009

Related U.S. Application Data

(60) Provisional application No. 61/053,819, filed on May 16, 2008.

(51) Int. Cl.
*B22C 9/00* (2006.01)
*B22C 25/00* (2006.01)
*B22D 5/04* (2006.01)

(52) U.S. Cl. ..... 164/323; 164/29; 164/329

(58) Field of Classification Search ..... 164/18, 164/27, 29, 322–324, 329–330
See application file for complete search history.

(56) References Cited

U.S. PATENT DOCUMENTS 4,108,234 A * 8/1978 Shine ..... 164/38
4,135,570 A * 1/1979 Muller ..... 164/182

* cited by examiner

*Primary Examiner* — Kuang Lin

(57) ABSTRACT

A mold-forming assembly for forming chemical set sand into a plurality of mold portions for one or more objects to be cast in the mold portions. The assembly includes a loading subassembly for forming the mold portions, a positioning subassembly for positioning each mold portion in a predetermined position, and a conveyor subassembly extending between the loading and positioning subassemblies, for moving the mold portions from the loading subassembly to the positioning subassembly.

2 Claims, 12 Drawing Sheets

MOLD-FORMING ASSEMBLY

This application claims the benefit of U.S. Provisional Application No. 61/053,819, filed May 16, 2008.

FIELD OF THE INVENTION

This invention is related to a mold-forming assembly for forming chemical set sand into a number of mold portions for one or more objects to be cast in the mold portions.

BACKGROUND OF THE INVENTION

Chemical set sand molds are commonly used in the casting of aluminum, brass, bronze, and iron products. For example, major automotive manufacturers typically use chemical set sand in their foundries. To prepare chemical set sand, the sand undergoes a "mulling" process in which various binding agents (e.g., various clay and chemical additives) are blended with the sand, which results in a mixture (i.e., chemical set sand) which is suitable for the sand molding process.

To form a mold, the prepared sand mixture is manually compressed around a pattern. After packing, the chemical set sand is allowed to set, or bond, so that it will maintain its shape throughout the remainder of the casting process. In this way, the blended sand and binders are compacted around the pattern and take on the shape of the desired casting, as is well known in the art.

As is also well known, the cavity in the sand is formed by a pattern (i.e., an approximate duplicate of the object to be cast), which is typically made out of wood, plastic or sometimes metal. The pattern is positioned in a box (known as a flask) into which the sand is placed. Accordingly, the cavity is contained in the sand in the flask after the sand has been packed around the pattern.

In a two-part mold, which is typical of sand castings, the upper half, (i.e., including the top half of the pattern) is called the cope and the lower half is called the drag. Typically, the drag is formed, after which the cope is formed. (Those skilled in the art would be aware that the cope may be prepared first.) After the cope and the drag are formed, the cope is positioned on top of the drag, aligned with the drag.

If the object to be cast is intended to be hollow, then a core is positioned in the cavity in the drag (i.e., before the cope is positioned on the drag), as is known.

In the prior art, the flask is filled (e.g., using a five-gallon pail), e.g., sand is placed around the pattern. Subsequently, a vibrator is positioned on the cope, and the cope is vibrated. When the sand is set, the cope is then rotated through approximately 180°.

The cope is then positioned on the drag. In the prior art, the rotation and the positioning of the cope are done manually. Because of the weight of the sand, two workers are needed. Also, because the cope and the drag are relatively heavy and need to be substantially vertically aligned, the task of positioning the cope on the drag is somewhat time-consuming and difficult.

In the prior art, up to 12 molds can be produced in one day using chemical set sand. However, as indicated above, the prior art process is relatively labor-intensive. The prior art process requires two people to set up the flask and place the pre-mixed chemical set sand in the mold, which is then allowed to cure, or harden. Each mold weighs 300 to 400 pounds. As described above, in the prior art, the drag and the cope are required to be moved and placed together relatively precisely. This manual process limits the number of units which can be produced per day due to the physical requirements, e.g., two people are required to rotate and position the molds, and time must be allowed for the binders in the sand to set.

SUMMARY OF THE INVENTION

In view of the foregoing, there is a need for a mold-forming assembly adapted to improve productivity.

In particular, it would be advantageous to speed up the existing process by having all of the casting components formed in one machine (i.e., a mold-forming assembly) of the invention and located therein, which may be automated (or at least partially automated) to perform the process with only one operator. In addition, the mold-forming assembly of the invention permits the time for setting the sand to be adjusted, allowing the number of molds which can be made in a single day to be controlled. In the invention, manual lifting and rotating is replaced with automatic lifting and rotating devices. With the mold-forming assembly of the invention, daily mold production capability is increased considerably.

BRIEF DESCRIPTION OF THE DRAWINGS

The invention will be better understood with reference to the attached drawings, in which:

FIG. 3B is a side view of the mold-forming assembly of FIG. 1, showing the first portion in a lowered position;

DETAILED DESCRIPTION

Figure 1:
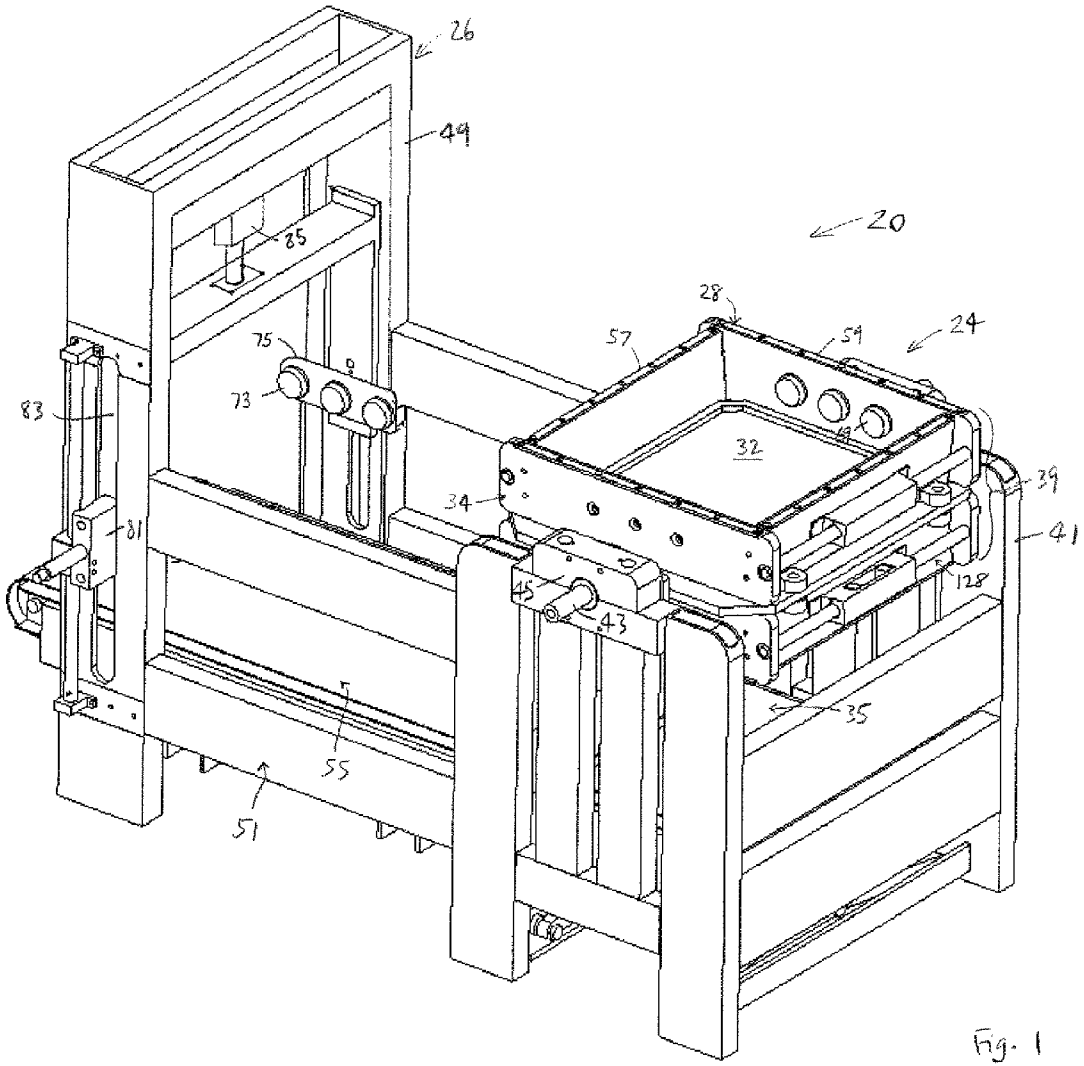
FIG. 1 is an isometric view of an embodiment of the mold-forming assembly of the invention.

Reference is made to FIGS. 1-9 to describe an embodiment of a mold-forming assembly of the invention generally indicated by the numeral 20. The mold-forming assembly 20 is for forming chemical set sand into a plurality of mold portions 22 for one or more objects (not shown) which are to be cast in the mold portions 22. The assembly 20 includes a loading subassembly 24 adapted for forming the mold portions 22, and a positioning subassembly 26 adapted for positioning each mold portion 22 in a predetermined position, as will be described. In one embodiment, the loading subassembly 24 includes one or more flasks 28 in which the sand is receivable, and a conveyor subassembly 30 extending between the loading and positioning subassemblies 24, 26, for moving the mold portions 22 from the loading subassembly 24 to the positioning subassembly 26. Preferably, each flask 28 includes a floor plate 32 and one or more walls 34 which are positionable around the floor plate 32 adapted to support a pattern for forming one or more cavities in the sand in which at least part of the object is formable in cast metal, and attachable to the floor plate 32 so that the floor plate 32 and the walls 34 at least partially define the flask 28.

As is well known, and as described above, the mold portion is made by packing sand around the pattern. The pattern may be positioned in the flask 28 in different ways. For example, patterns may be integrally formed or permanently attached to the floor plates to form cope- and drag-pattern plates. The floor plate 32 may be a pattern plate. The pattern may also be included in a match-plate pattern, in which the cope and drag portions of the pattern are mounted on opposite sides of a plate. For the purposes hereof, the term "pattern plate" refers collectively to all of cope- and drag-pattern plates and match plates. It will also be appreciated by those skilled in the art that the pattern does not necessarily have to be mounted on the plate. Also, those skilled in the art will be aware that cores may also be positioned in mold portions, as will be described.

Also, and as will be described, the walls 34 of the flask 28 preferably include two "long" walls and two "short" walls. However, those skilled in the art will appreciate that the flask 28 does not necessarily have to have this configuration.

In one embodiment, the conveyor subassembly 30 preferably includes a first portion 35 thereof which is vertically movable, for receiving the mold portion 22 upon release thereof from the flask 28.

In one embodiment, the loading subassembly 24 additionally includes a rotation means 36 for inverting selected mold portions 22. As will be described, the selected mold portions 22 preferably are cope portions 37.

In another embodiment, the positioning subassembly 26 additionally comprising an elevating means 38 for lifting the cope portions 37, thereby positioning the cope portions in preselected positions in relation to the corresponding drag portions 40 thereof.

Similarly, where the mold portion 22 being moved by the conveyor subassembly 30 is a drag portion 40, the drag portion 40 is positioned by the positioning subassembly 26 so that the cope portion 37, when lowered onto the drag portion 40 by the elevating means 38, is substantially vertically aligned with the drag portion 40.

Figure 10A:
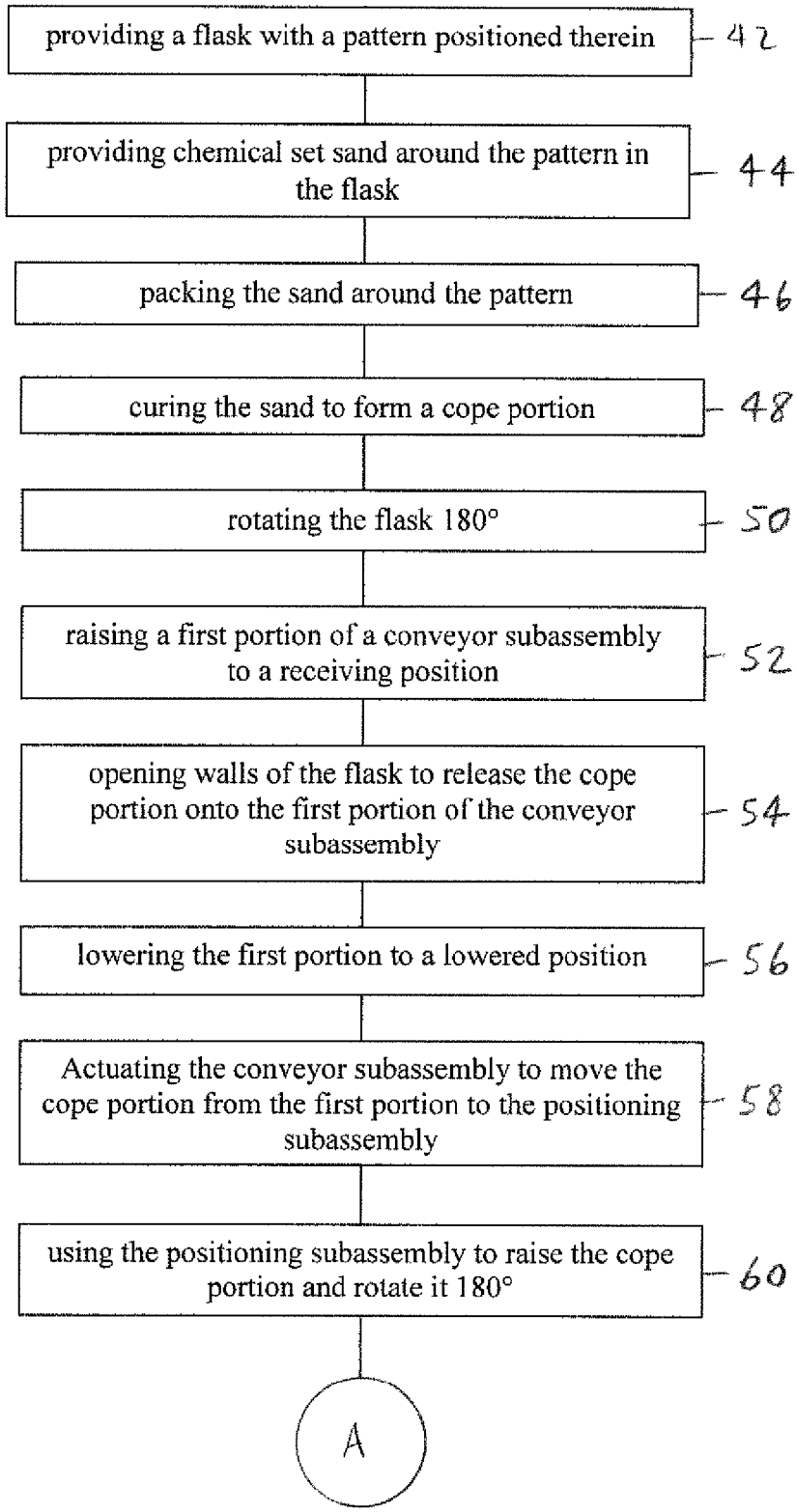
FIG. 10A is a schematic illustration of a portion of an embodiment of a method of the invention.
Figure 10B:
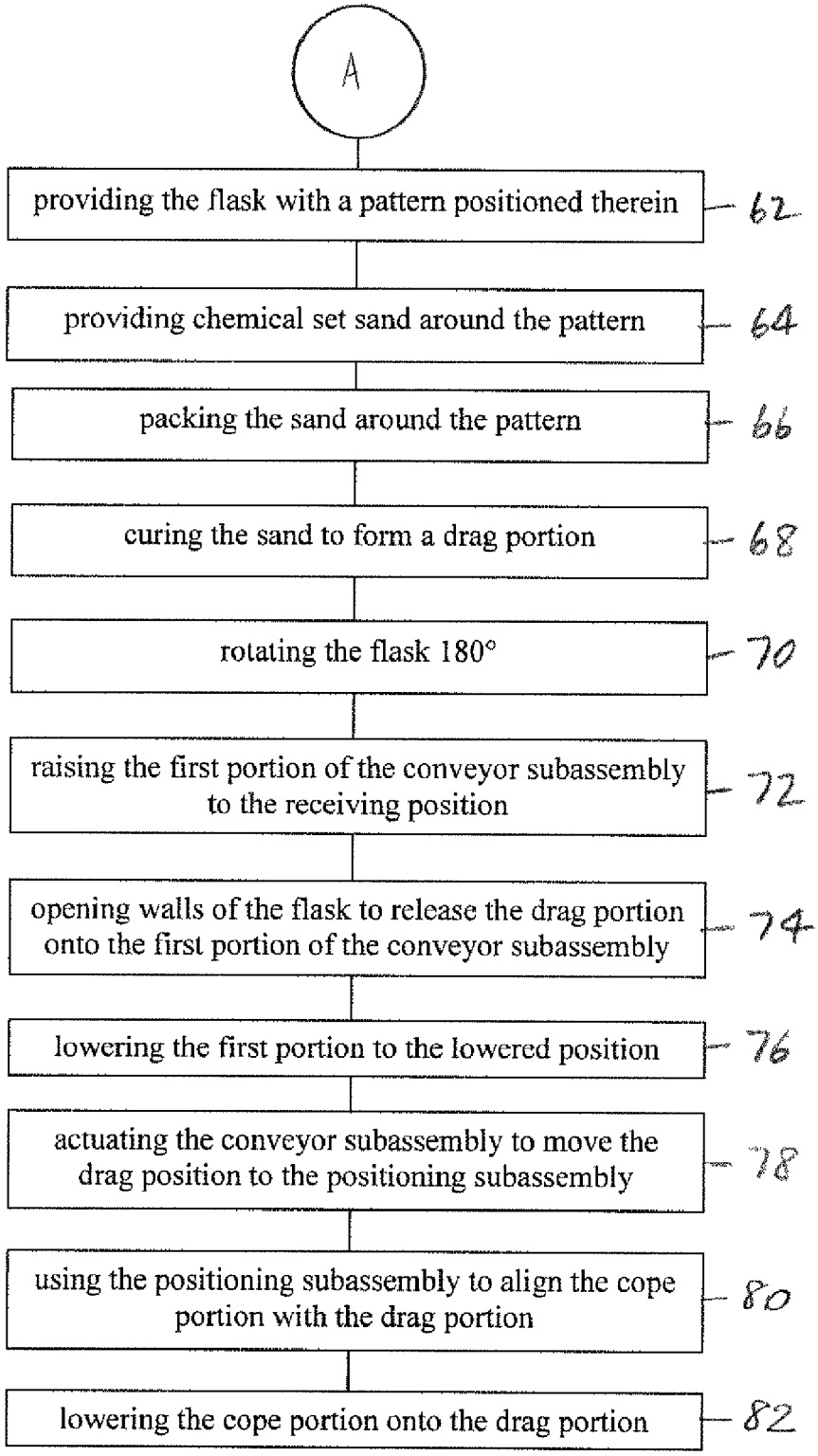
FIG. 10B is a schematic illustration of another portion of an embodiment of a method of the invention.

In use, and as schematically represented in FIGS. 10A and 10B, first, the flask 28 is provided with the pattern positioned therein (step 42, FIG. 10A). Next, chemical set sand is positioned around the pattern in the flask 28 (step 44). Subsequently, the sand is packed around the pattern (step 46). The sand is then allowed to cure for a predetermined time period, to form the cope portion 37 (step 48).

Once the sand has cured, the flask 28 is rotated 180° (step 50). The first portion 35 of the conveyor subassembly 30 is raised to a raised position (FIG. 3A) (step 52). Next, the walls 34 of the flask 28 are opened to release the cope portion 37 onto the first portion 35 of the conveyor subassembly 30 (step 54).

The first portion 35 of the conveyor subassembly 30, with the cope portion 37 thereon, is lowered to a lowered position (FIG. 3B), in which the first portion 35 is substantially aligned with a second portion 55 of the conveyor subassembly 30 (step 56). As can be seen in FIG. 3B, the first and second portions 35, 55 are positioned end-to-end and sufficiently proximal to each other that the cope portion 37 is transferred from the first portion to the second portion when the portions 35, 55 are both actuated.

Next, the conveyor subassembly 30 is actuated to move the cope portion 37 from the first portion 35 to a predetermined position on the second portion 55 of the conveyor subassembly 30, in which the cope portion 39 is engageable by the positioning subassembly 26 (step 58). Subsequently, the positioning subassembly 26 engages the cope portion 37 the cope portion 37, and then rotates the cope portion 180° (step 60). At this point in the process, the cope portion 37 is in a position to be lowered onto a drag portion 40, as will be described.

Figure 2:
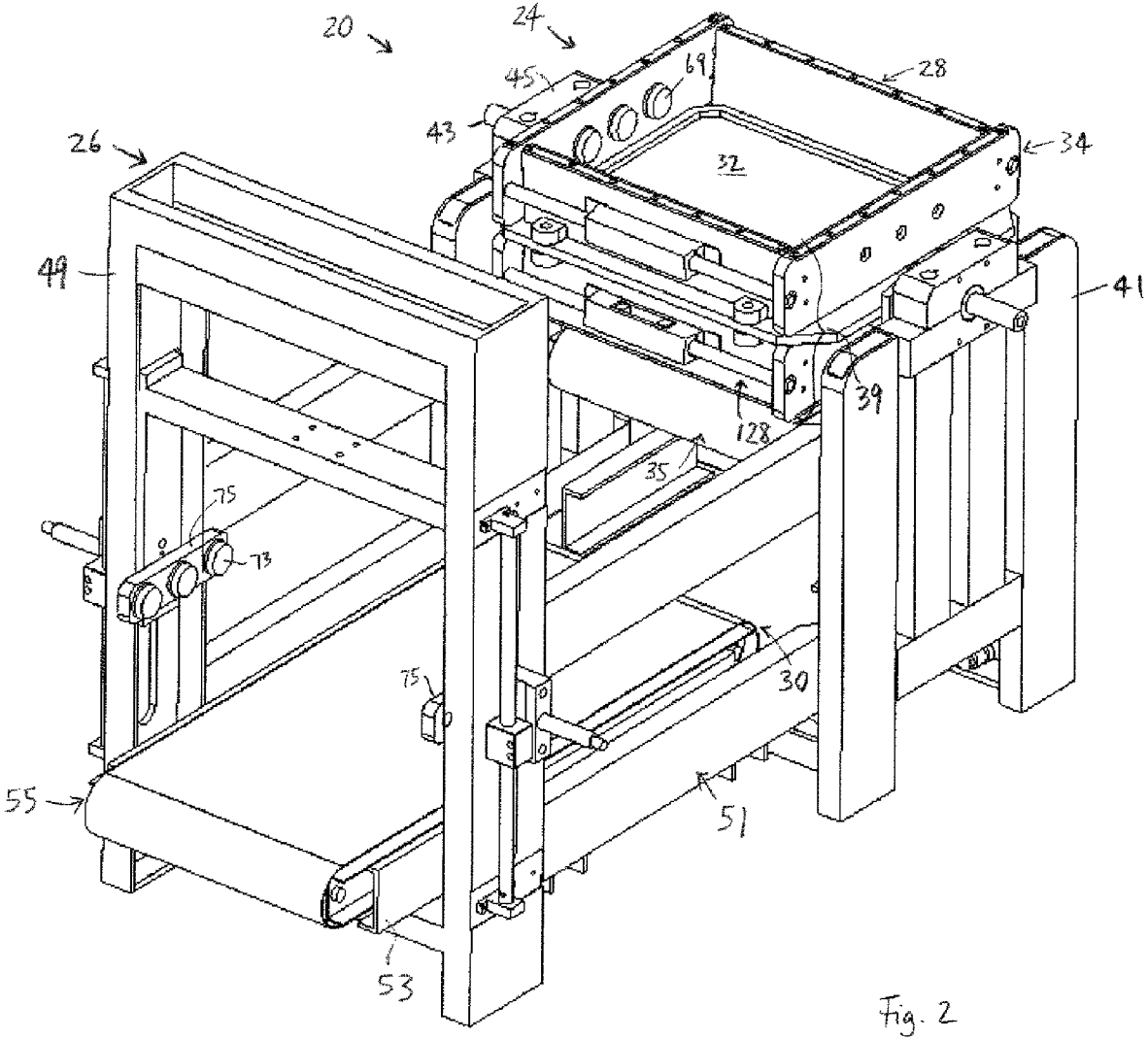
FIG. 2 is another isometric view of the mold-forming assembly of FIG. 1.

As can be seen in FIG. 2, the molding assembly 20 preferably includes a second flask 128. The second flask 128 and the flask 28 preferably are positioned relative to each other so that, when one of the flasks 28, 128 is facing downwardly, the other flask is facing upwardly, and ready to receive sand to form another mold portion.

Because of this configuration, an operator can begin positioning and packing sand around the pattern in the flask which is positioned to receive sand while the other flask is positioned for discharge of the mold portion formed therein. For example, the operator may place sand in the flask 128 to form the drag portion 40 immediately after the flask 28 has been rotated (i.e., step 50 described above). Accordingly, it will be understood that steps 62-76 are not necessarily performed after steps 52-60, notwithstanding the manner in which these steps are presented in FIGS. 10A and 10B.

After the flask 28 has been rotated (step 50, set out above), the flask 128 is then positioned to receive additional chemical set sand, to form the drag portion 40 (step 62, FIG. 10B). In the next step, chemical set sand is provided around the pattern (step 64). Next, the sand is packed around the pattern (step 66). The sand is cured to form the drag portion 40 (step 68). The flask 128 is rotated 180° (step 70). Upon rotation of the flask 128 through 180°, the flask 28 is also so rotated, so that the flask 28 is thus placed in an upright position, in which chemical set sand may be placed in the flask 28 and packed around the pattern, to form the next cope 37.

The first portion 35 of the conveyor subassembly 30 is raised to the receiving position (step 72). The walls 34 of the flask 28 are opened to release the drag portion 40 onto the first portion 35 of the conveyor subassembly 30 (step 74). The first portion 35 is lowered to the lowered position (step 76). Next, the conveyor subassembly 30 is actuated to move the drag portion 40 to the predetermined position on the second portion 55 (step 78). The positioning subassembly 26 is used to substantially align the cope portion 37 and the drag portion 40 (step 80), as will be described. Next, the cope portion 37 is lowered by the positioning subassembly 26 onto the drag portion 40 (step 82).

It will be appreciated by those skilled in the art that, once the cope portion 37 has been positioned on the drag portion 40 (as described above) to form a mold assembly 84, the mold assembly 84 preferably is then removed from the conveyor subassembly 30, for further processing. After the mold assembly 84 has been formed, the conveyor subassembly 30 preferably is actuated to move the mold assembly 84 onto a carousel or another conveyor (not shown), whereby the mold assembly 84 is moved to a position where molten metal (or such other molten material as is to be used) may be poured into the mold assembly to form the object, as is well known in the art. It will be understood that, when the mold assembly 84 is formed, the cope 37 engages the drag 40. Those skilled in the art will appreciate that the gap shown between the cope and the drag (at "X", in FIGS. 3A-3C) is for illustrative purposes only, i.e., in FIG. 3B the positions of the cope and the drag relative to each other as the cope is lowered onto the drag are shown.

Figure 3A:
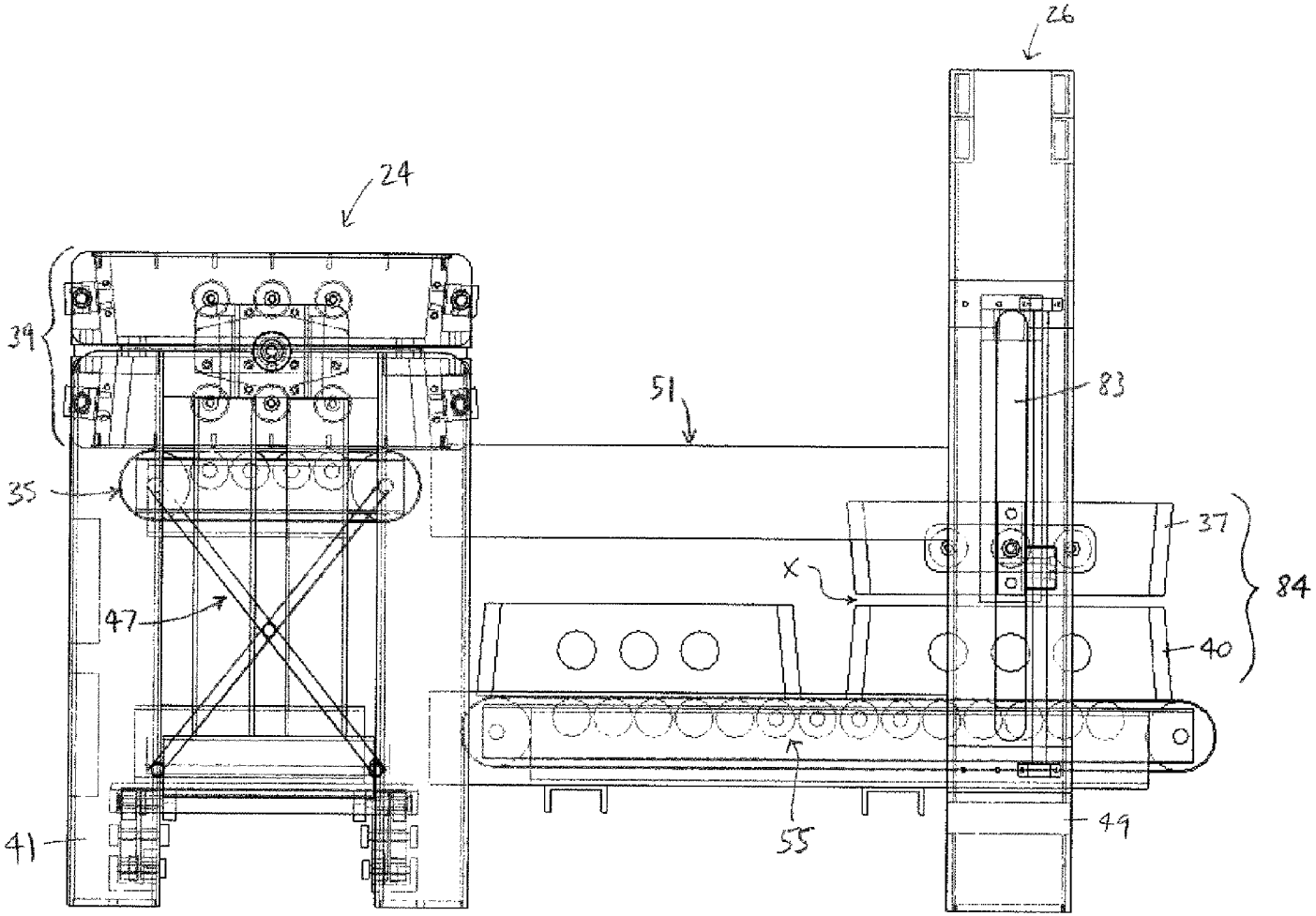
FIG. 3A is a side view of the mold-forming assembly of FIG. 1, showing a first portion of a conveyor subassembly in a raised position.
Figure 3A:
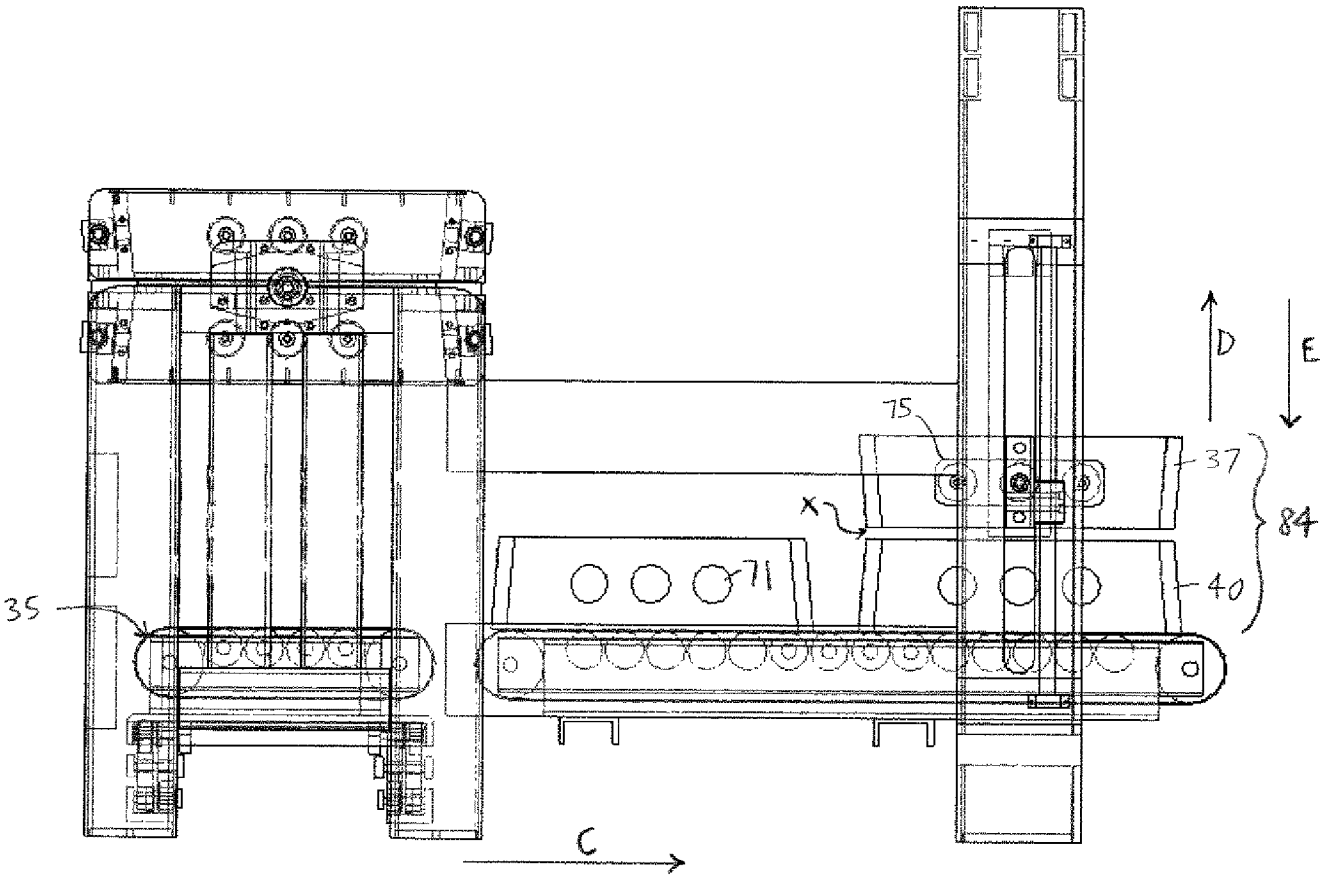
Figure 3C:
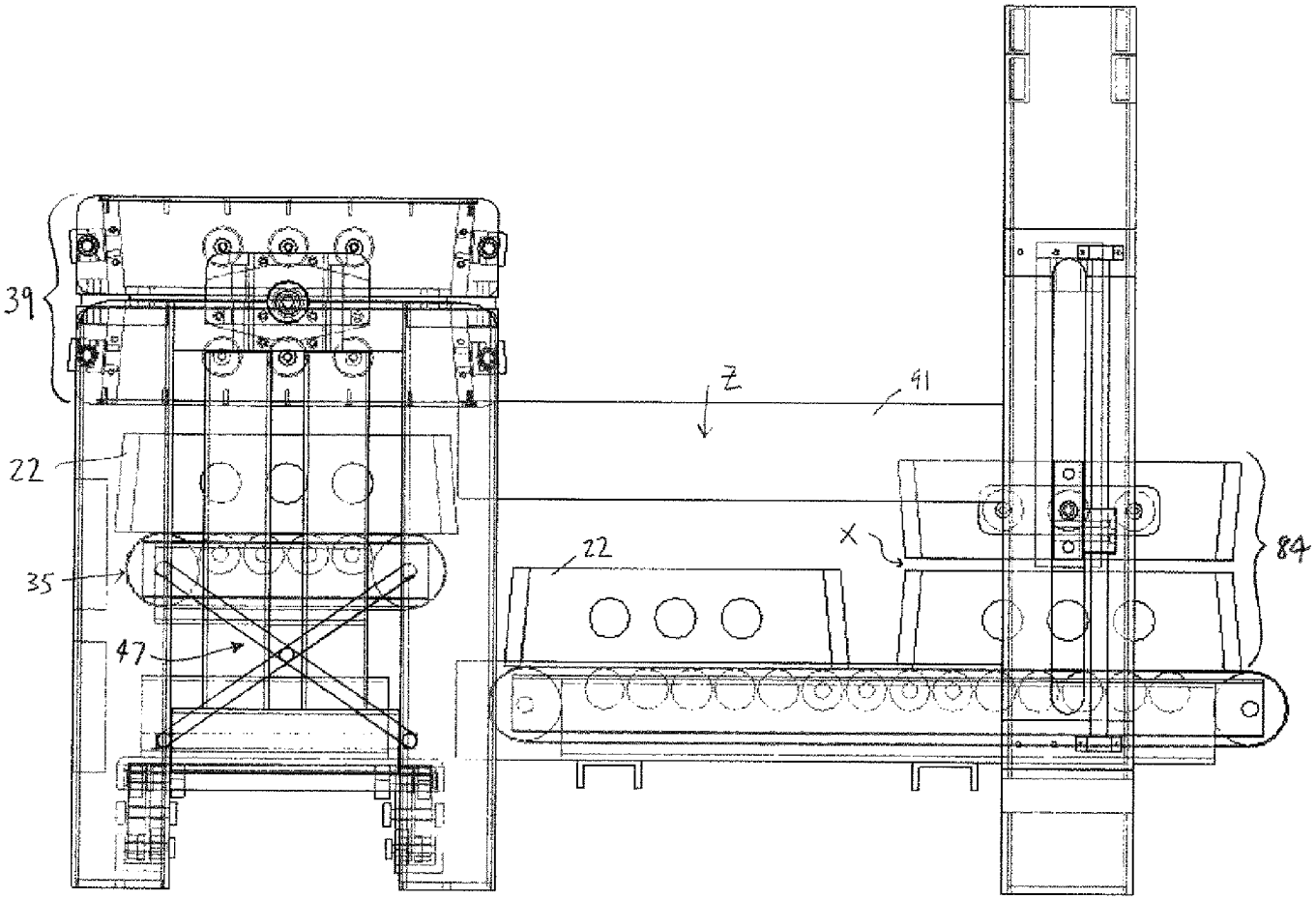
FIG. 3C is a side view of the mold-forming assembly of FIG. 1, showing the first portion in an intermediate position, between the raised and lowered positions.
Figure 4:
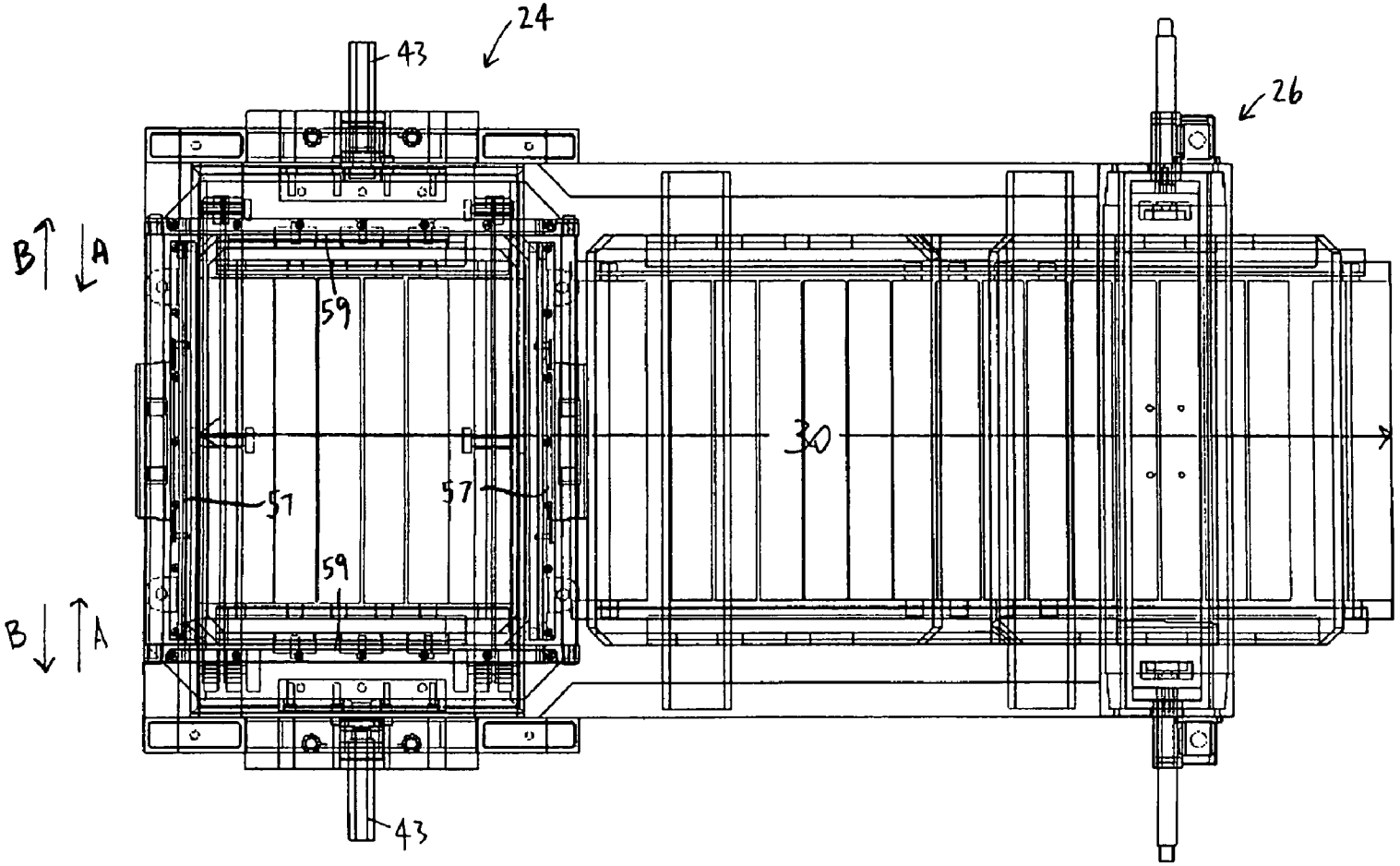
FIG. 4 is a top view of the mold-forming assembly of FIG. 1.
Figure 5:
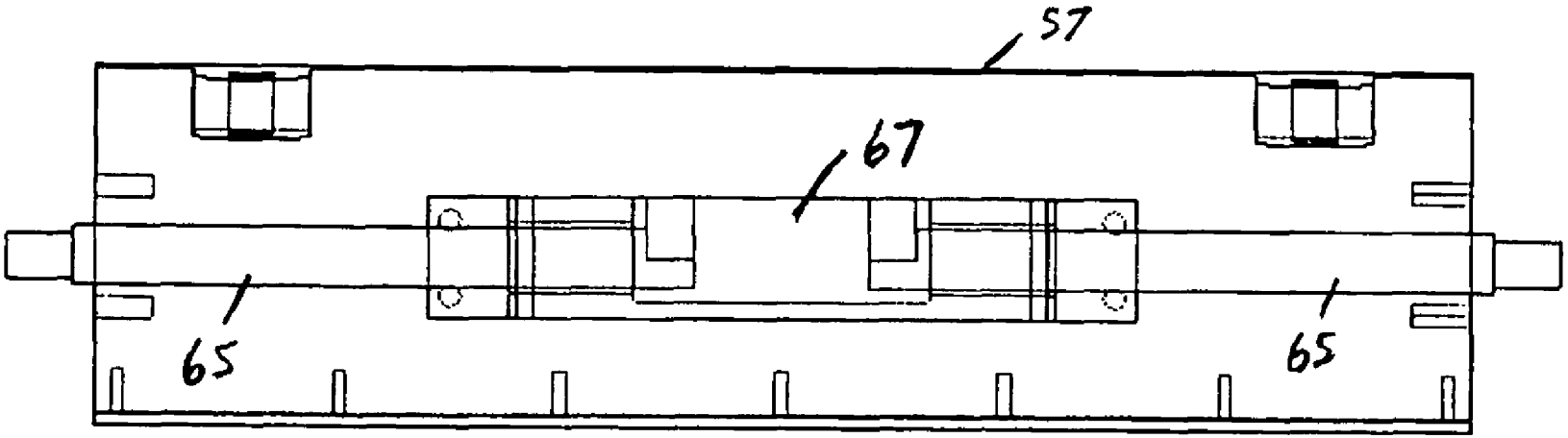
FIG. 5 is a side view of an embodiment of a long wall of a flask of the invention, drawn at a larger scale.
Figure 6:
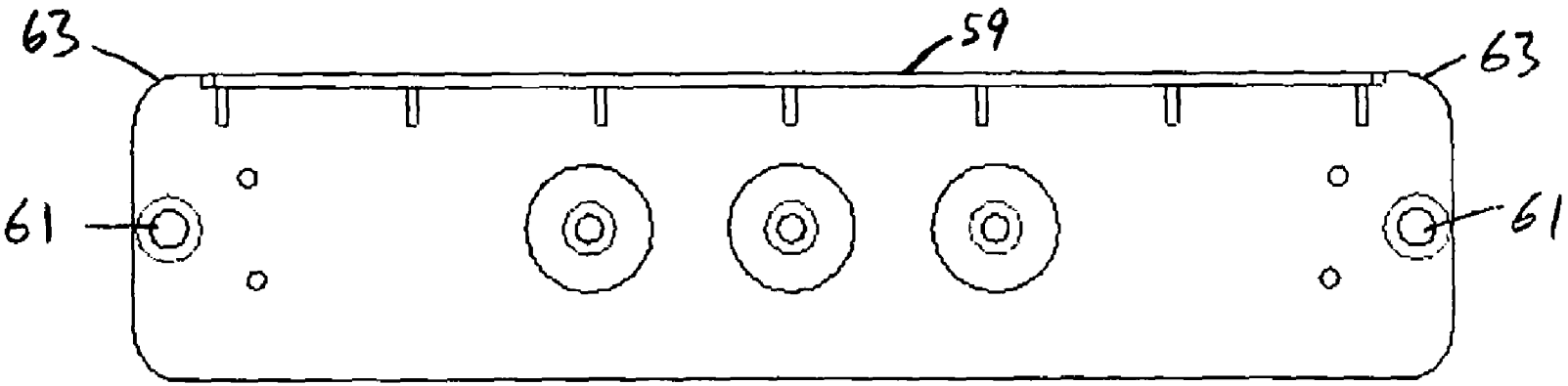
FIG. 6 is a side view of an embodiment of a short wall of the flask of the invention.

Preferably, the flasks 28, 128 are positioned back-to-back to form a flask unit 39 (FIG. 1). As can be seen in FIGS. 1 and 2, the loading subassembly 24 preferably includes a first frame portion 41 which supports the flask unit 39. Axles 43 extend from the sides of the flask unit 39 and are positioned in bushings 45 mounted on the frame portion 41 so that the flask unit 39 is rotatable about a substantially horizontal axis defined by the axles 43. As shown in FIG. 3A, the first portion 35 is supported by a scissor lift arrangement 47, the scissor lift being mounted near the bottom of the first frame portion 41. The scissor lift 47 is adapted to move the first portion 35 between the raised position (FIG. 3A) and the lowered position (FIG. 3B) upon actuation thereof.

As can be seen in FIGS. 1 and 2, the positioning subassembly 26 preferably includes a second frame portion 49. The first and second frame portions 41, 49 are connected by a third frame portion 51 (FIGS. 1, 2, and 3A). As can be seen in FIG. 3A, the third frame portion includes a lower member subassembly 53 which supports the second portion 55 of the conveyor subassembly 30. Preferably, the lower member 53 extends beyond the positioning subassembly 26.

It will be understood that the flask 128 is substantially the same as the flask 28 in all relevant respects, the only difference being differences in the patterns, i.e., the patterns for the cope and drag portions may differ. Accordingly, it will be understood that the following description of the flask 28 is equally applicable to the flask 128.

As can be seen in FIGS. 1 and 2, the flask 28 preferably includes two first walls 57 and two second walls 59. In one embodiment, each second wall 59 preferably includes a hole 61 at each end 63 thereof. Each first wall 57 also preferably includes rods 65 movable inwardly (i.e., in the direction of arrow "A" in FIG. 4) and outwardly (i.e., in the direction of arrow "B" in FIG. 4). Preferably, the rods 65 are moved by hydraulic cylinders 67, but those skilled in the art would appreciate that other means could be used for moving the rods 65. Each rod 65 is secured to the second wall 59 at the hole 61, so that movement of the rods in and out causes the second walls 59 to move in and out relative to the first wall 57.

Figure 7:
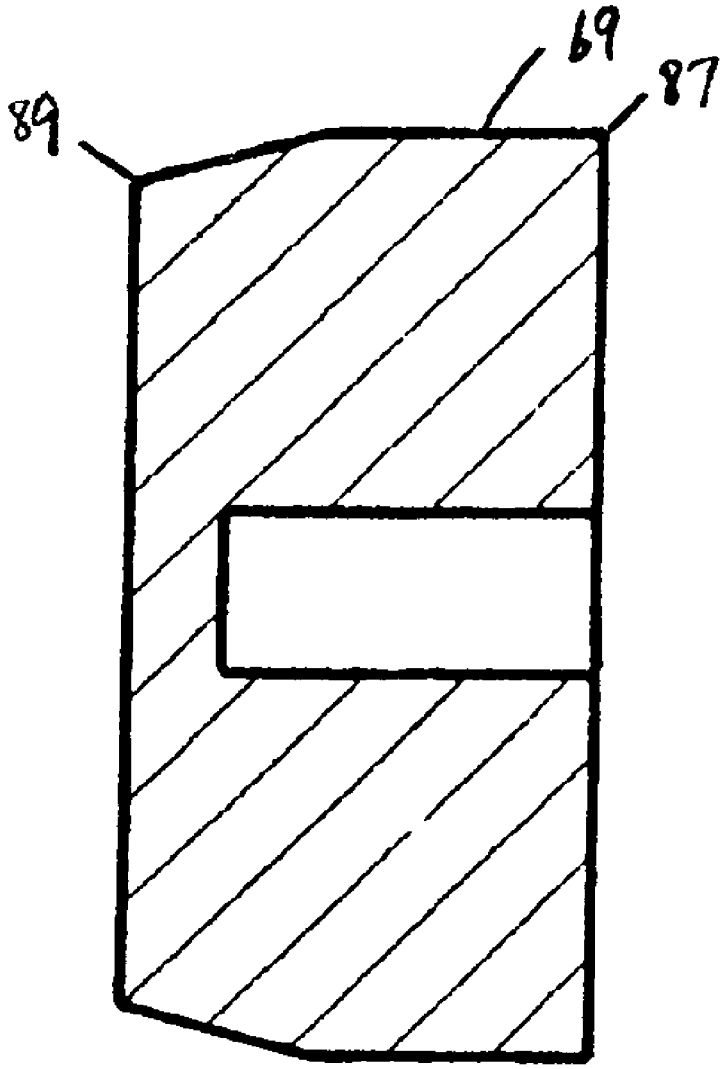
FIG. 7 is a cross-section of an embodiment of a lug of the invention, drawn at a larger scale.
Figure 9:
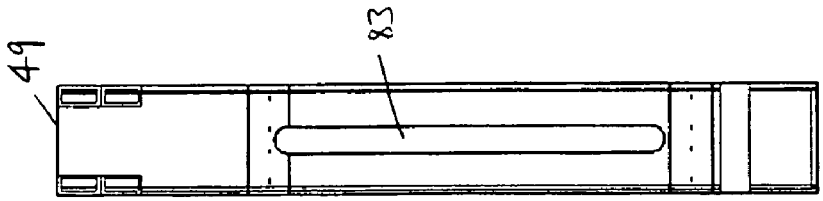
FIG. 9 is a side view of the frame of FIG. 8.
Figure 8:
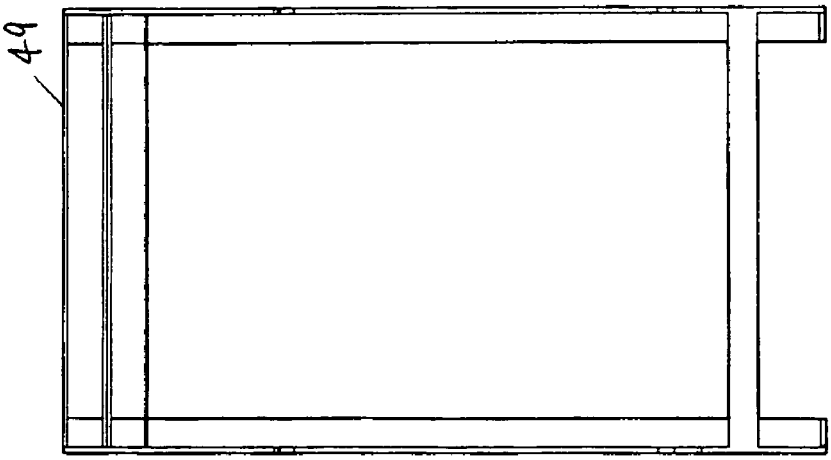
FIG. 8 is a front view of an embodiment of a frame portion of a positioning subassembly of the invention, drawn at a smaller scale.

The second walls 59 include lugs 69 which are mounted in the second walls 59 so that the lugs 69 extend into the sand, after the sand has been packed around the pattern. In this way, the lugs 69 form recesses 71 in the mold portions 37, 40 when the mold portions are formed. As can be seen in FIG. 7, in one embodiment, each lug 69 is generally tapered between and outer edge 87 and an inner edge 89. For example, the lug 69 may partially define one or more cones. The intention is to form recesses in which the lug 69 and also other lugs 73 (such lugs 73 being shaped and dimensioned to be substantially the same as the lugs 69) are receivable in a relatively close locational clearance fit.

When the rods 65 are fully withdrawn (FIGS. 1, 2), the second walls 59 are held tightly against the first walls 57, so that the flask 28 is ready to receive sand. After the flask has been rotated 180°, the mold portion 37 is primarily held in the flask by the lugs 69. However, in steps 54 and 74, the rods are pushed outwardly, to open the walls (i.e., to displace the second walls 59 so that they are spaced apart from the first walls 57), thereby removing the support from the mold portion 37 provided by the lugs 69. Because the first portion 35 of the conveyor subassembly 30 is, at that point, in the raised position, the mold portion 37 is gently placed on the first portion when the lugs 69 are withdrawn.

Those skilled in the art will appreciate that many different arrangements could be used, and the flask described in the foregoing description is exemplary only. For example, many different means for moving the rods could be used, e.g., electric motors or compressed air. Also, many different mechanisms for opening and closing the walls could be used.

As described above, the first portion 35 is lowered to the lowered position, and then moved to the positioning subassembly 26 (i.e., in the direction indicated by arrow "C" in FIG. 3B) by the first and second portions 35, 55.

The cope portion 37 preferably is moved toward the positioning subassembly 26 by the second portion 55 of the conveyor subassembly 30 (i.e., in the direction indicated by arrow "C") until the cope portion 37 is in the predetermined position relative to the positioning subassembly 26. Once the cope portion 37 is in the predetermined position, the second portion 55 stops, and the grippers 75 extend to engage the cope portion 37.

Control of the second portion 55, i.e., to stop it so as to position the cope portion in the predetermined position, may be effected in various ways. Preferably, an electric eye is used which is controlled to stop the second portion, and which is adapted for adjustment based on the size of the mold portion.

Once the cope portion 37 is in the predetermined position, the grippers 75 extend inwardly to push lugs 73 on the grippers 75 into the recesses 71 in the cope portion 37. Preferably, as described above, the lugs 73 have a generally tapered shape receivable in the recesses 71 in a relatively close fit. Because of the shape of the lugs 73 and the recesses 71, the action of pushing the lugs 73 into the recesses 71 may have the effect of moving the cope portion 37 a small distance laterally, thereby better positioning the cope portion 37, i.e., more precisely in the predetermined position, if required. The grippers 75 hold the cope portion 37 as it is raised upwardly (i.e., as indicated by arrow "D" in FIG. 3B) by an elevating means 85 (FIG. 1) which is included in the positioning assembly 26. The grippers 75 are mounted on bodies 81 which are positioned in slots 83 (FIG. 9), and the slots guide the bodies 81 as they travel vertically. Preferably, once the cope portion 37 has been raised sufficiently above the second portion 55, the grippers 75 rotate the cope portion 37 through 180° so that the cope portion 37 is held in position to be lowered onto the drag portion 40. Preferably, at least one motor or similar device (not shown) is mounted on at least one of the grippers 75 to cause this rotation, and such motor is actuated by a controller once the cope portion 37 is at a preselected height above the conveyor.

Next, the drag portion 40 which immediately follows the cope portion 37 held by the grippers 75 is moved into the predetermined position under the raised cope portion 37. As with the cope portion (described above), movement of the drag portion to the predetermined position, and stopping the second portion to effect this, preferably is controlled via an electric eye device which is approximately calibrated.

Once the drag portion 40 is in the predetermined position (FIGS. 3A, 3B, 3C), the cope portion 37 is lowered onto the drag portion 40 (i.e., in the direction indicated by arrow "E" in FIG. 3B). Preferably, the cope portion 37 is vertically aligned with the drag portion 40 (i.e., the drag portion 40 being located in the predetermined position, as shown in FIG. 3B), so that the mold 84 is properly formed when the cope portion 37 is positioned on the drag portion 40. After the cope portion is so positioned, the grippers 37 are withdrawn, thereby releasing the cope portion. The mold 84 is then moved by the second portion 55 in the direction indicated by arrow "C" in FIG. 3B, to another conveyor or carousel (not shown). At the same time, the next cope portion 37 is moved to the predetermined position by the second portion 55, so that it can be raised, rotated, and positioned on the next drag portion 40 by the positioning subassembly 26.

In one embodiment, the third frame portion 51 is adapted to permit the operator to locate a core (if required) in the mold portion 22 as the mold portion 22 is moved by the second portion 55 of the conveyor subassembly 30. For example, the operator (not shown) may be located at "Z" in FIG. 3C. Preferably, a top member 91 of the third frame portion 51 is positioned at a height which is sufficiently low that the operator can relatively easily have access to the mold portion 22 as it moves on the second portion 55, to enable the operator to position the core in the mold portion properly.

It is preferred that the mold assembly 20 is controlled by the controller which provides for control of the various means for moving parts of the assembly 20. The controller preferably is configured to cause the various elements to be actuated in the appropriate sequence so that the process of the invention is substantially automatic, using a central processing unit and software developed for the purpose. Preferably, the controller is adapted to permit variations in various parameters relating to the characteristics of the mold portions 22 which are to be formed.

Also, the assembly 20 preferably includes a number of sensors positioned and calibrated to provide for safe operation of the assembly. For example, a mechanical sensor (not shown) preferably is located on the first portion 35, projecting above the first portion 35 to engage the flask unit 39 when the first portion is moved to the raised position, to cause the first portion's upward movement to stop so that the first portion is properly positioned in the raised position. Also, as described above, the mold portions 22 are properly positioned at the predetermined position at the positioning subassembly 26 due to signals generated by the electric eye. Similarly, as a safety feature, the assembly 20 preferably includes a "curtain" sensor at an outer side of the frame 49 which is adapted to stop the operation of the positioning subassembly if any object is inserted into the "curtain" of infrared light.

Any element in a claim that does not explicitly state "means for" performing a specific function, or "step for" performing a specific function, is not to be interpreted as a "means" or "step" clause as specified in 35 U.S.C. §112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

We claim:

1. A mold-forming assembly for forming chemical set sand into a plurality of cope and drag portions for at least one object which is to be cast in the cope and drag portions, the assembly comprising:

a loading subassembly adapted for forming said cope and drag portions;

a positioning subassembly adapted for assembling each said cope and drag portions in a predetermined position;

the loading subassembly comprising;

at least one flask in which the sand is receivable, said at least one flask comprising:

a floor plate adapted to support a pattern for forming at least one cavity in the sand in which at least a part of said at least one object is formable in cast metal;

at least one wall positionable around the pattern plate and attachable to the pattern plate such that the pattern plate and said at least one wall at least partially define said at least one flask; and a rotation means for inverting selected ones of said cope and drag portions along with said at least one flask; and a conveyor subassembly extending between the loading and positioning subassemblies, for moving said cope and drag portions from the loading subassembly to the positioning subassembly, wherein said conveyor subassembly comprising a "first portion vertically movable, for receiving said cope and drag portions upon release thereof respectively from said at least one flask.

2. A mold-forming assembly according to claim 1 in which the positioning subassembly additionally comprises an elevation means for lifting said selected ones of said cope and drag portions to position said selected ones in preselected positions in relation to others of said cope and drag portions.

* * * * *